US012108813B2

(12) United States Patent
Thompson

(10) Patent No.: US 12,108,813 B2
(45) Date of Patent: Oct. 8, 2024

(54) BREAST PUMP MOVEMENT MITIGATION BRASSIERE

(71) Applicant: Burble LLC, Fort Collins, CO (US)

(72) Inventor: Rebecca Ann Thompson, Fort Collins, CO (US)

(73) Assignee: Burble LLC, Fort Collins, CO (US)

( * ) Notice: Subject to any disclaimer, the term of this patent is extended or adjusted under 35 U.S.C. 154(b) by 481 days.

(21) Appl. No.: 17/535,769

(22) Filed: Nov. 26, 2021

(65) Prior Publication Data

US 2023/0165318 A1 Jun. 1, 2023

(51) Int. Cl.
*A41C 3/04* (2006.01)
*A41C 5/00* (2006.01)

(52) U.S. Cl.
CPC . *A41C 3/04* (2013.01); *A41C 5/00* (2013.01)

(58) Field of Classification Search
CPC ..... A41C 3/04; A41C 3/0028; A41C 5/005
See application file for complete search history.

(56) References Cited

U.S. PATENT DOCUMENTS 7,056,186 B1 * 6/2006 Weyenberg ..... A41C 3/02 450/65
10,441,002 B2 * 10/2019 Ironi ..... A41C 3/04
2006/0228988 A1 * 10/2006 Weyenberg ..... A41C 3/0028 450/58
2011/0177757 A1 * 7/2011 Swendseid ..... A41C 3/0057 2/113
2011/0275277 A1 * 11/2011 Martins-Crawbuck ..... A41C 3/0028 450/77
2012/0021669 A1 * 1/2012 Johnstone ..... A41C 3/02 450/86
2012/0220192 A1 * 8/2012 Swendseid ..... A41C 3/0028 450/85
2016/0037830 A1 * 2/2016 Swendseid ..... A41C 3/0028 450/54
2016/0081399 A1 * 3/2016 Tempesta ..... A41C 3/0014 450/70
2020/0029631 A1 1/2020 Tsutsui et al.
2020/0288791 A1 * 9/2020 Breitwieser ..... A41C 3/0057
2021/0205511 A1 7/2021 O'Toole et al.
2023/0013689 A1 * 1/2023 Edmark ..... A41F 1/002
2023/0147056 A1 * 5/2023 Mitsunobu ..... C22C 38/002 428/659
2023/0172286 A1 * 6/2023 Holland ..... A41C 3/02 450/1

(Continued)

*Primary Examiner* — Gloria M Hale
(74) *Attorney, Agent, or Firm* — Craig R. Miles; CR MILES P.C.

(57) ABSTRACT

A brassiere including a brassiere front part including brassier left and right cups adapted to cover the left and right breasts of the brassiere wearer and a left wing and a right wing correspondingly extending from the brassiere left cup and brassiere right cup, the front part defining a brassiere upper edge and a brassiere lower edge connected to a brassiere underband including an brassiere underband adjustor operable to adjust the brassiere underband length to reconfigure the brassiere when breast pumps are positioned between the brassiere wearer breasts and the brassiere wearer side of the brassiere cups to increase pumping efficiency or mitigate movement of breast pumps during expression and collection of breast milk from the brassiere wearer.

20 Claims, 5 Drawing Sheets

(56) References Cited

U.S. PATENT DOCUMENTS

| | | | | |
|---|---|---|---|---|
| 2023/0240383 | A1* | 8/2023 | Cuervo | A41F 1/006<br>450/58 |
| 2023/0346049 | A1* | 11/2023 | Zhang | A41C 3/0057 |

* cited by examiner

BREAST PUMP MOVEMENT MITIGATION BRASSIERE

I. FIELD OF THE INVENTION

Generally, the present invention relates to a brassiere which mitigates movement of breast pumps positioned between the brassiere wearer breasts and the brassiere wearer side of the brassier cups during expression and collection of breast milk from the brassiere wearer. Specifically, the present invention relates to a brassiere including a brassiere front part including brassier left and right cups adapted to cover the left and right breasts of the brassiere wearer and a left wing and a right wing correspondingly extending from the brassiere left cup and brassiere right cup, the front part defining a brassiere upper edge and a brassiere lower edge connected to a brassiere underband including an brassiere underband adjustor operable to adjust the brassiere underband length to reconfigure the brassiere when breast pumps are positioned between the brassiere wearer breasts and the brassiere wearer side of the brassiere cups to mitigate movement of breast pumps during expression and collection breast milk from the brassiere wearer.

II. BACKGROUND OF THE INVENTION

Breast pumps configured as a single wearable device for the expression and collection of breast milk are becoming increasing popular. In certain instances, the breast pump components can be contained in a housing having a configuration that can be disposed between the wearer side of a brassier cup and the brassiere wearer breast during the expression and collection of breast milk.

However, current configurations of brassieres can allow movement of the breast pump away from the breast during the expression and collection of breast milk necessitating mitigation of breast pump movement by the wearer which can substantially curtail the efficiency of breast milk collection or the activity of the wearer during the expression and collection of breast milk.

Accordingly, there would be substantial advantage in provision of a brassiere having components that can disposed in first brassiere configuration which supports the left and right breasts of the brassiere wearer during periods in which the breast pump(s) are not disposed between the wearer side of the brassiere cup and the brassiere wearer, and can be disposed in a second brassiere configuration during periods in which the breast pump(s) are disposed between the wearer side of a brassiere cup and the brassiere wearer to mitigate movement of the breast pump in relation to the left or right breast(s), or to increase expression of breast milk over a period of time, which advantages alone or in combination can afford a substantial increase in the activity of the wearer during breast milk expression and collection or in the efficiency in the method of expression and collection of breast milk.

III. SUMMARY OF THE INVENTION

A brassiere reconfigurable to mitigate movement of a breast pump positioned between a brassiere wearer breast and a brassiere wearer side of a brassiere cup during expression and collection breast milk from the brassiere wearer breast, the brassier including a brassiere front part including a brassiere left cup and a brassiere right cup adapted to cover the left and right breasts of the brassiere wearer and a left wing and a right wing correspondingly extending from said the brassiere left cup and the brassiere right cup, the front part defining a brassiere upper edge and a brassiere lower edge connected to a brassiere underband, and a brassiere underband adjustor operable to adjust a brassiere underband length to reconfigure the brassiere having said breast pump positioned between the brassiere wearer breast and the brassiere wearer side of the brassiere brassier cup to mitigate movement of the breast pump during the expression and the collection of the breast milk from the brassiere wearer breast.

Naturally, further objects of the invention are disclosed throughout other areas of the specification, drawings, photographs, and claims.

IV. BRIEF DESCRIPTION OF THE DRAWINGS

V. DETAILED DESCRIPTION OF THE INVENTION

Figure 1:
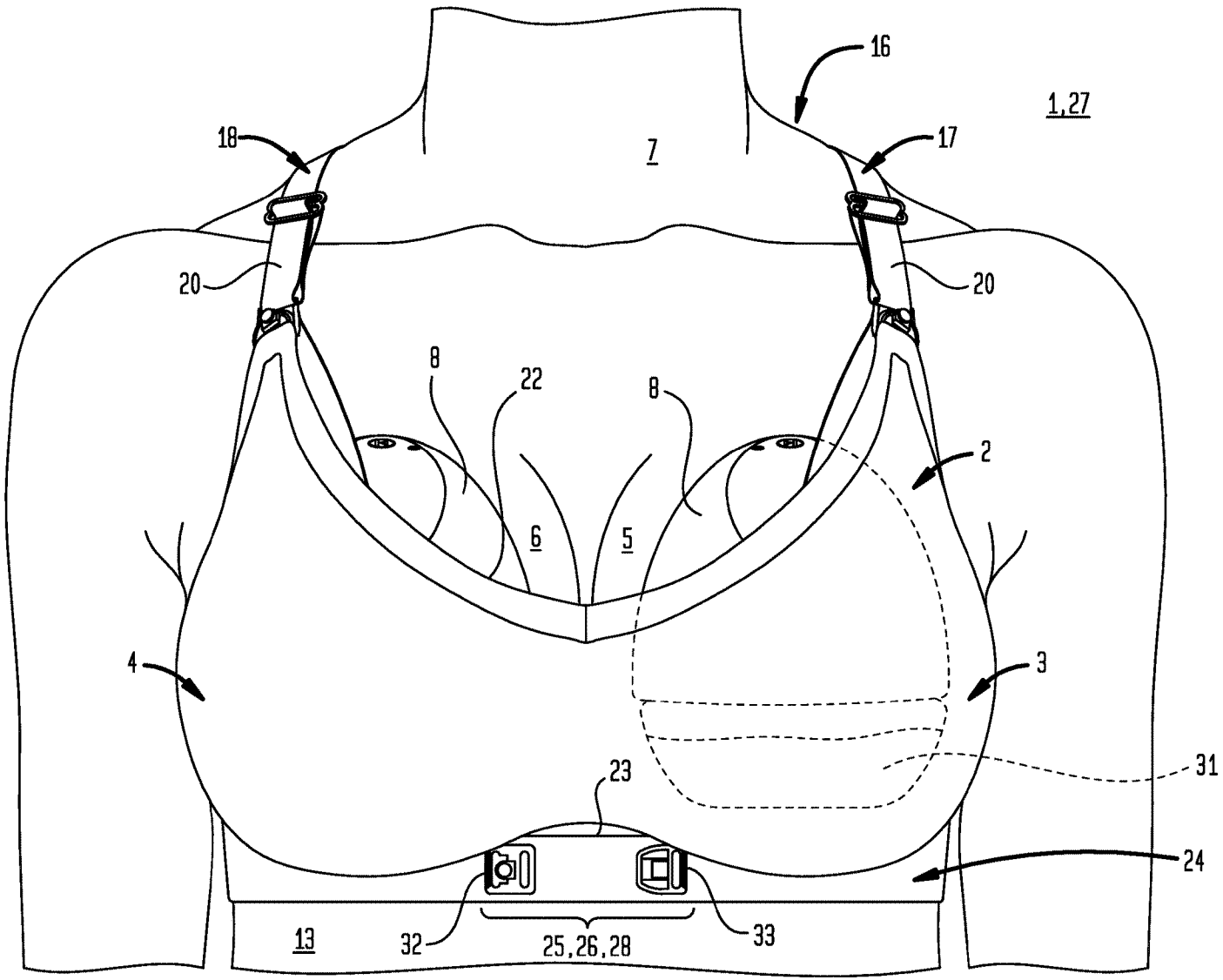
FIG. 1 is an illustration of a method of using an embodiment of the inventive brassiere in a first configuration which disposes the brassiere underband in a first underband length to allow a breast pump to be received between a brassiere wearer breast and a brassiere wearer side of a brassiere cup.

Generally, FIGS. 1 through 5, illustrate examples of a breast pump movement mitigation brassier (1) (also referred to as the "brassiere") according to the present invention. Embodiments of the brassiere (1) can include a brassiere front part (2) having at least one of a brassiere left cup (3) and a brassier right cup (4) adapted to correspondingly cover a left breast (5) and a right breast (6) of a brassiere wearer (7). Each of the brassiere left cup (3) or the brassiere right cup (4) can, but need not necessarily, be further adapted to receive a breast pump (8) positioned between the left breast (5) or the right breast (6) of a brassiere wearer (7) and a brassiere wearer side (9) of the left brassiere cup (3) or the right brassiere cup (4). A brassiere back part (10) can include a left wing (11) and a right wing (12) correspondingly extending from the brassiere left cup (3) and the brassiere right cup (4) of the brassiere front part (2). The left wing (11) and the right wing (12) can be configured to encircle a torso (13) of the brassiere wearer (7). In particular embodiments, the left wing (11) and the right wing (12) can be integral or one piece, while in other embodiments, the left wing (11) and the right wing (12) can include a left wing terminal portion (14) and a right wing terminal portion (15) which can releasably connect at a brassiere wearer back side (16) to encircle the torso (13) of the brassiere wearer (7). In particular embodiments, a left shoulder strap (17) or a right shoulder strap (18), or combination thereof, can have a strap length (19) disposed between a strap front end (20) connected to the brassiere front part (2) and a strap back end (21) connected to the brassiere back part (10). In particular embodiments the left shoulder strap (17) and the right shoulder strap (18) may cross on the brassiere wearer back side (16). The brassiere front part (2) and the brassiere back part (10) can define a brassiere upper edge (22) and a brassiere lower edge (23). A brassiere underband (24) can be connected to the brassiere lower edge (23) at least on the brassiere front part (2) of the brassiere (1), and in particular embodiments, extend along the brassiere lower edge (23) on all or a portion of the brassiere back part (10).

The materials of the members of the brassiere (1) are not particularly limited, and synthetic fibers such as polyester fibers and polyamide fibers, or cellulose fibers such as rayon, cupra and acetate, and natural fibers such as cotton and hemp can be used to construct various embodiments. The structure of the material constituting the members is also not particularly limited, and a knitted material, woven material, or non-woven material can be used alone or in various combinations. A material can be selected having appropriate elasticity characteristics for each member. As an illustrative example, an elastic interwoven material such as SPANDEX® can, but need not necessarily, be used for one or more of the members. Furthermore, double circular knit materials, tricot knit materials, or raschel knit materials can be used as the materials of the brassiere front part (2), the brassiere rear part (10), shoulder straps (17) (18), or underband (24), and combinations thereof.

Figure 2:
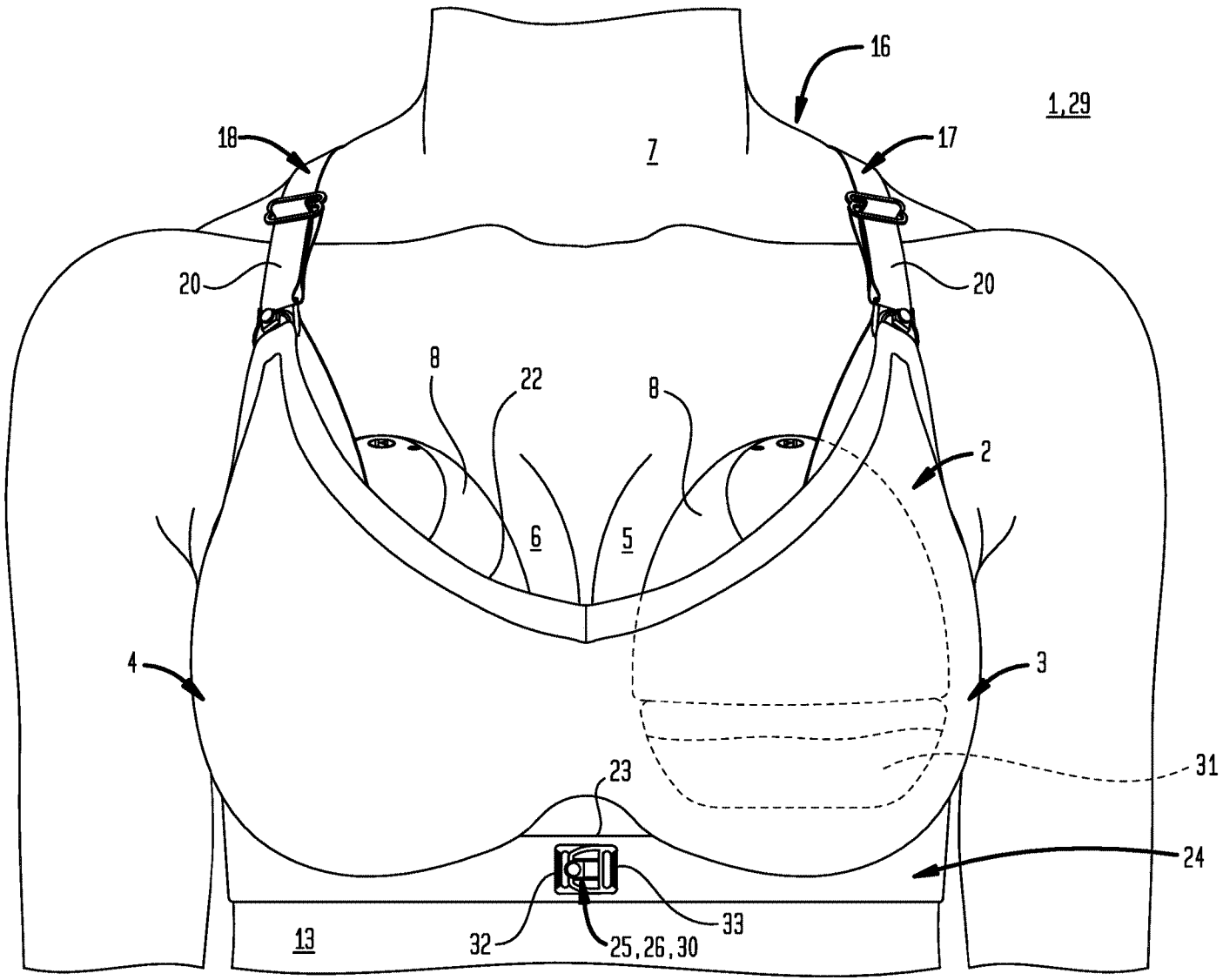
FIG. 2 is an illustration of a method of using an embodiment of the inventive brassiere in a second configuration in which an underband adjuster operates to dispose the brassiere underband at a second underband length which increases efficiency of breast pumping or mitigates movement of the breast pump positioned between a brassiere wearer breast and a brassiere wearer side of a brassiere cup.
Figure 3:
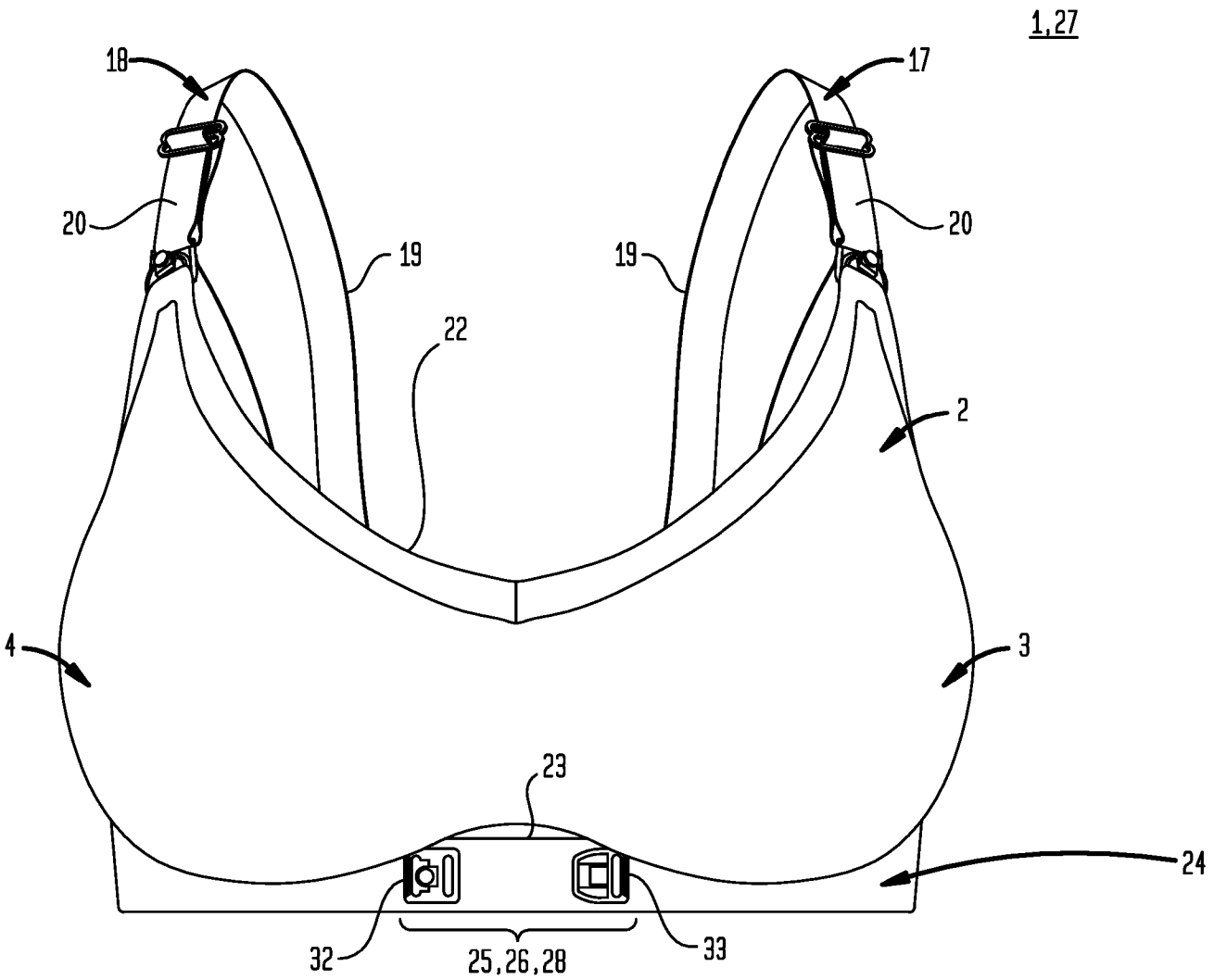
FIG. 3 is a front elevation view of an embodiment of the inventive brassiere having the brassiere underband disposed in a first underband length.
Figure 4:
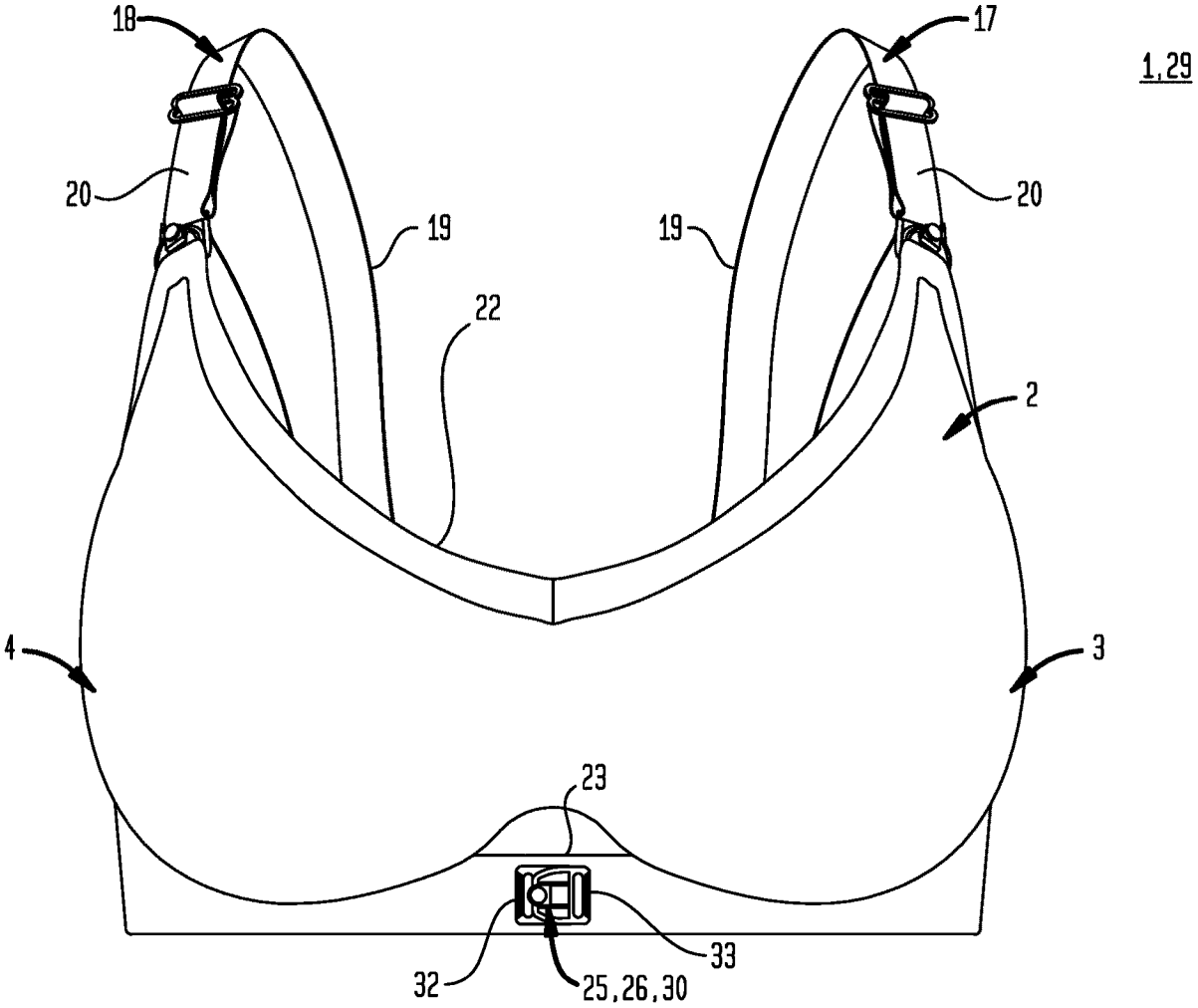
FIG. 4 is a front elevation view of an embodiment of the inventive brassiere having the brassiere underband disposed in a second underband length by operation of an underband adjustor.
Figure 5:
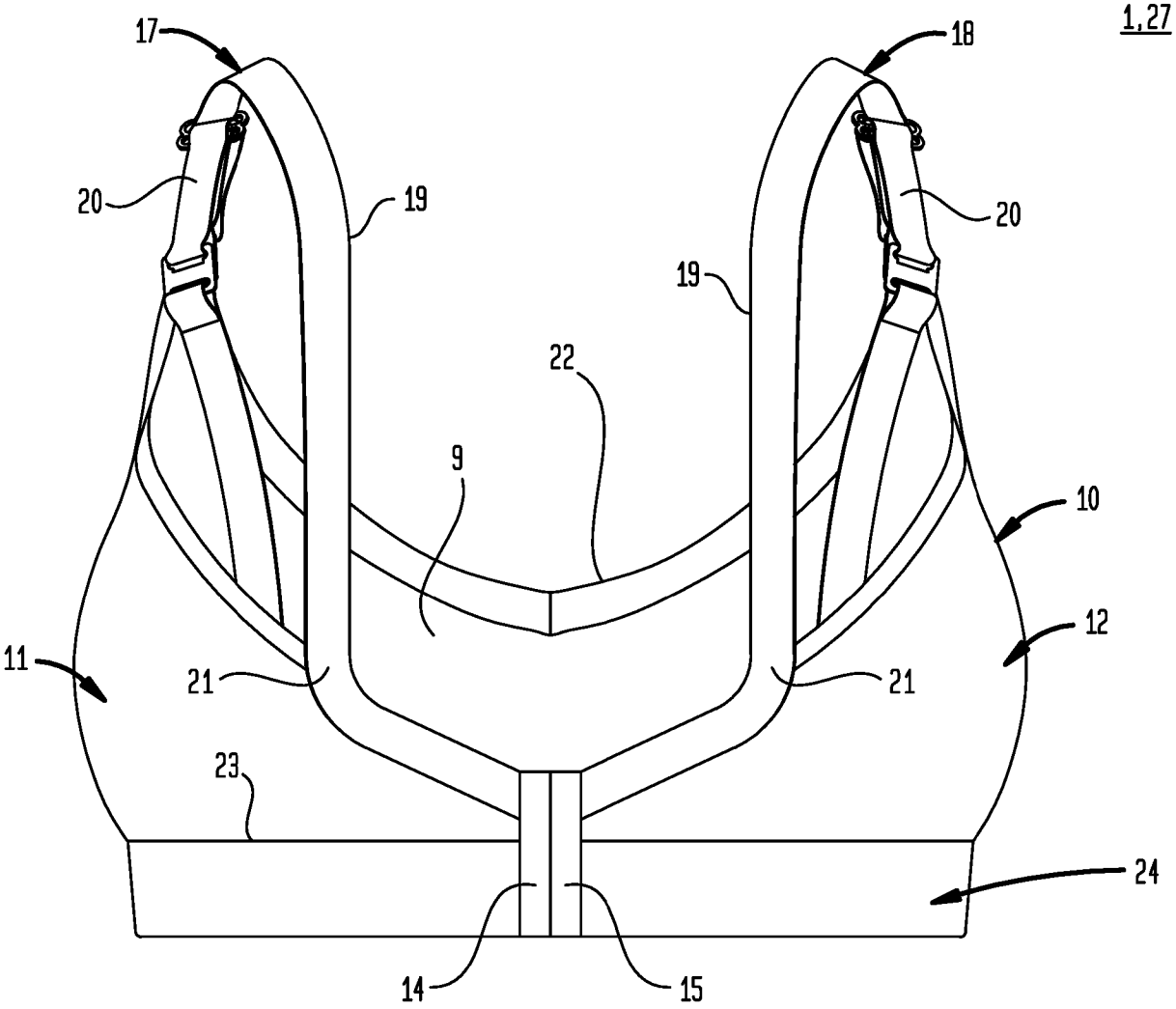
FIG. 5 is rear elevation view of an embodiment of the inventive brassiere

Embodiments of the brassiere (1) include a brassiere underband adjustor (25) operable to adjust a brassiere underband length (26) to reconfigure the brassiere (1) from a brassiere first configuration (27) in which the brassiere underband (24) has a first underband length (28) (as shown in the example of FIGS. 1 and 3) and a breast pump (8) is not positioned, or allows positioning of the breast pump (8), between the brassiere wearer (7) left breast (5) or right breast (6), or both, and the brassiere wearer side (9) of the corresponding brassiere left cup (3) or brassiere right cup (4), or both, and a brassiere second configuration (29) in which the brassiere underband has a second underband length (30) (as shown in the example of FIGS. 2 and 4), wherein the first underband length (28) is greater than the second underband length (30), and in which the breast pump (8) is positioned between the brassiere wearer (7) left breast (5) or right breast (6) and the brassiere wearer side (9) of the brassiere left cup (3) or the brassiere right cup (4). The second underband length (30) can be adjusted by operation of the brassiere underband adjustor (25) to generate sufficient tension in the brassiere underband (24) to urge the brassiere wearer side (9) of the brassiere left cup (3) and brassiere right cup (4) against the breast pump(s) (8) positioned in the brassiere left cup (3) or the brassiere right cup (4).

In the first instance, urging the breast pump (8) against the left breast (5) or right breast (6) by operation of the underband adjustor (25) can mitigate the amount of movement of the breast pump (8) during expression and collection of breast milk (31) from the brassiere wearer (7) left breast (5) or right breast (6). The term "mitigate" for the purposes of this invention means to cause to become less. In particular embodiments, the brassiere underband adjustor (25) can be operated to generate one or more brassiere second configurations (29) which mitigates or selectively mitigates the amount of movement of the breast pump (8) positioned between the left breast (5) or the right breast (6) of a brassiere wearer (7) and a brassiere wearer side (9) of the left brassiere cup (3) or the right brassiere cup (4). The term "selectively mitigates" for the purposes of this invention means small positive or negative changes in the underband length (30) affording corresponding incremental re-configuration of the brassiere (1) in a plurality of states of the brassiere second configuration (29) allowing a selected amount of movement of the breast pump (8) positioned between the left breast (5) or the right breast (6) of a brassiere wearer (7) and a brassiere wearer side (9) of the left brassiere cup (3) or the right brassiere cup (4).

In the second instance, mitigating movement of the breast pump (8) positioned between the left breast (5) or the right breast (6) of a brassiere wearer (7) and a brassiere wearer side (9) of the left brassiere cup (3) or the right brassiere cup (4) can afford increased mobility in the wearer (7). The term "mobility" for the purposes of this invention means the ability of the wearer (7) to move with breast pump (8) positioned between the left breast (5) or the right breast (6) of a brassiere wearer (7) and a brassiere wearer side (9) of the left brassiere cup (3) or the right brassiere cup (4) during expression and collection of breast milk (31).

In the third instance, urging the breast pump (8) against the left breast (5) or right breast (6) by operation of the underband adjustor (25) can correspondingly achieve breast compression of the left breast (5) or the right breast (6) resulting in an increase in the expression of breast milk (31) from the left breast (5) or the right breast (6) of the brassiere wearer (7). The term "breast compression" for the purposes of this invention means applying pressure to the left breast (5) or the right breast (6).

In the fourth instance, urging the breast pump (8) against the left breast (5) or right breast (6) by operation of the underband adjustor (25) can increase an amount of breast milk (31) expressed per unit time. Referring to Table I below, there can be a substantial increase in the amount of breast milk (31) expressed per unit time by operation of the brassiere underband adjustor (25) to generate the brassiere second configuration (29). The term "expression" for the purposes of this invention means the flow of breast milk (31) out of the breast (5, 6). The level of expression of breast milk (31) (referred to as "pumping volume" in Table I) can be characterized as a volume of breast milk (31) per unit time.

TABLE I

| | Conventional Brassiere | Std. Deviation Conventional | Inventive Brassiere | Std. Deviation Inventive |
|---|---|---|---|---|
| Pumping Volume $\bar{x}$ (milliliters "mL") | 212 | 30 | 228 | 29 |
| Pumping Time $\bar{x}$ (minutes "min.") | 19 | 3 | 17.7 | 3 |
| Pumping Efficiency $\bar{x}$ (mL/min.) | 11.9 | 3 | 13.6 | 4 |

The experimental method used to generate the data presented in Table I, included positioning a brassiere front part including a brassiere left cup and a brassiere right cup of either a brassiere without the underband adjustor (25) (the control brassiere) or the inventive brassiere (1) (the experimental brassiere) to correspondingly cover a left breast (5) and a right breast (6) of a brassiere wearer (7), wherein the control brassiere and the inventive brassiere (1) having substantially the same or the same structure, with the exception that the inventive brassiere (1) included the underband adjustor (25). The method further including positioning a breast pump (8) between each the left breast (5) and the right breast (6) and a brassiere wearer side of the corresponding brassiere left cup (3) or the brassier brassiere right cup (4) of the control brassiere or the inventive brassiere (1). The method further including, with respect only to the inventive brassier (1), operating a brassiere underband adjustor (25) to adjust a brassiere underband length (24) to correspondingly urge the breast wearer side (9) of the brassiere left cup (3) or said brassier the brassiere right cup (4) against the breast pumps (8) engaged with the left breast (5) and the right breast (6) of the brassiere wearer (7). The method for both the conventional brassiere and the inventive brassiere (1) further including operating the breast pumps (8) engaged with the left breast (5) and the right breast (6) of the brassiere wearer (7) for either a period of twenty minutes, or a lesser period of time (the "pumping time" in minutes) in which breast milk (31) is collected from the combination of the left breast (5) and the right breast (6) (the "pumping volume" in milliliters) (each a "session"). The procedure was performed with the control brassiere in eighteen sessions (18*x*) and with inventive brassiere in thirteen sessions (13*x*). The average (x) pumping time and the average (x) pumping volume presented in Table I were each corresponding calculated as the sum of the pumping times or the sum of the pumping volumes divided by the number of sessions. The pumping efficiency was calculated as the average pumping volume divided by the average pumping time to afford the average (x) pumping efficiency.

Now, with primary reference to FIGS. 1 through 4, the structure of the underband adjustor (25) need not be particularly limited, and can be structured in a wide variety of configurations which allow the brassiere underband (24) to be adjusted from the first underband length (28) to the second underband length (30) to correspondingly afford reconfiguration of the brassiere (1) from the brassiere first configuration (27) to the brassiere second configuration (29). Accordingly, suitable structures to allow reduction in the underband length (26) can include, but need not be limited to, one or more of: a slide affording adjustable length to a strap overlaying the underband, the strap can passing around the central bar of the slide or directly through one of the slide slots to a ring and returns through that slot across the central bar and through the other slot in the slide; a slide having a hook; a J-hook and an eye; a snap fastener; a hook and loop material such as VELCRO®; and a button and a button hole, and combinations thereof.

Now, with primary reference to FIGS. 1 through 4, an embodiment of the brassiere underband adjustor (25) includes a first connector part (32) interconnectable with a second connector part (33). The first connector part (32) unconnected to the second connector part (33) can afford the brassiere first configuration (27) of the brassiere (1) in which the brassiere underband (24) has a first underband length (28) as shown in the illustrative examples of FIGS. 1 and 3. The first connector part (32) connected to the second connector part (33) can afford the brassiere second configuration (29) of the brassiere (1) in which the brassiere underband (24) has the second underband length (30) as shown in the illustrative example of FIGS. 2 and 4.

Now, with primary reference to FIGS. 1 through 4, an embodiment of the brassiere underband adjustor (25) can, but need not necessarily, include a first connector part (32) selectably interconnectable with any one of a plurality of second connector parts (33) disposed in spaced apart relation along a portion of the brassiere underband (24). The wearer (7) can connect the first connector part (32) to each of the plurality of second connector parts (33) to afford corresponding incremental re-configuration of the brassiere (1) to each of a plurality of states of the brassiere second configuration (29) to correspondingly select the desired amount of movement of the breast pump (8) positioned between the left breast (5) or the right breast (6) of a brassiere wearer (7) and a brassiere wearer side (9) of the left brassiere cup (3) or the right brassiere cup (4) or select the level of expression of breast milk (31).

Breast pump(s) (8) suitable for use with embodiments of the brassiere (1) operable for the expression and collection breast milk (31) from the left breast (5) or the right breast (6) of the brassiere wearer (7) include as illustrative examples: Willow-Willow Model No. C2739 available from Willow, 1975 West El Camino Real, Suite 306, Mountain View, California 94040; and Elvie Pump, ChiaroTechnology Ltd., 63-66 Hatton Garden Second Floor, London, United Kingdom EC1N8LE.

As can be easily understood from the foregoing, the basic concepts of the present invention may be embodied in a variety of ways. The invention involves numerous and varied embodiments of a brassiere and methods for making and using such brassiere including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "adjustor" should be understood to encompass disclosure of the act of "adjusting"—whether explicitly discussed or not—and, conversely, were there is a disclosure of the act of "adjusting", such a disclosure should be understood to encompass disclosure of a "adjustor" and even a "means for adjusting". Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Further, for the purposes of the present invention, the term "coupled" or derivatives thereof can mean indirectly coupled, coupled, directly coupled, connected, directly connected, or integrated with, depending upon the embodiment.

Additionally, for the purposes of the present invention, the term "integrated" when referring to two or more components means that the components (i) can be united to provide a one-piece construct, a monolithic construct, or a unified whole, or (ii) can be formed as a one-piece construct, a monolithic construct, or a unified whole. Said another way, the components can be integrally formed, meaning connected together so as to make up a single complete piece or unit, or so as to work together as a single complete piece or unit, and so as to be incapable of being easily dismantled without destroying the integrity of the piece or unit.

Thus, the applicant(s) should be understood to claim at least: i) each of the brassieres herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application, if any, provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon. The elements following an open transitional phrase such as "comprising" may in the alternative be claimed with a closed transitional phrase such as "consisting essentially of" or "consisting of" whether or not explicitly indicated the description portion of the specification.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A brassiere, comprising:

a brassiere front part including a brassiere left cup and a brassiere right cup adapted to cover a left breast and a right breast of a brassiere wearer, said front part defining a brassiere upper edge and a brassiere lower edge;

a brassiere underband connected to said brassiere lower edge; and a brassiere underband adjustor coupled to said brassiere underband, wherein said brassiere underband adjustor comprises a first connector part and a second connector part coupled in spaced apart relation on said brassiere underband to dispose said brassiere underband in a first underband length, said first connector part interconnectable with a second connector part at the front center of said brassiere underband in a second underband length.

2. The brassiere of claim 1, further comprising a brassiere back part including a left wing and a right wing correspondingly extending from said brassiere left cup and said brassiere right cup to a backside of said wearer.

3. The brassiere of claim 2, further comprising a left shoulder strap or a right shoulder strap having a strap length disposed between a strap front end connected to said brassiere front part and a strap back end connected to said brassiere back part.

4. The brassiere of claim 1, wherein said brassiere underband comprises an inelastic material or an elastic material.

5. The brassiere of claim 1, wherein said second underband length lesser than said first underband length.

6. The brassiere of claim 5, wherein said first underband length allows a breast pump to be positioned between a brassiere wearer breast and a brassiere wearer side of said brassiere left cup and/or said a brassiere right cup.

7. The brassiere of claim 6, wherein said second underband length mitigates movement of said breast pump positioned between said brassiere wearer breast and said brassiere wearer side of said brassiere left cup and/or said a brassiere right cup.

8. The brassiere of claim 5, wherein said first connector part selectably interconnectable with any one of a plurality of second connector parts disposed in spaced apart relation along a front portion of said brassiere underband to incrementally reconfigure said brassiere from a first brassiere configuration to each one of a plurality of states of a brassiere second configuration.

9. The brassiere of claim 1, wherein said brassiere underband adjustor comprises one or more of: a slide, a slide having a hook, a J-hook and eye, a snap, hook and loop, a button and a button hole, and combinations thereof.

10. A method of making a brassiere, comprising:

producing a brassiere front part including a brassiere left cup and a brassiere right cup adapted to cover a left breast and a right breast of a brassiere wearer, said front part defining a brassiere upper edge and a brassiere lower edge;

connecting a brassiere underband to said brassiere lower edge; and coupling a brassiere underband adjustor to said brassiere underband, wherein said brassiere underband adjustor comprises a first connector part and a second connector part coupled in spaced apart relation on said brassiere underband to dispose said brassiere underband in a first underband length, said first connector part interconnectable with a second connector part at the front center of said brassiere underband in a second underband length.

11. The method of claim 10, further comprising producing a brassiere back part including a left wing and a right wing correspondingly extending from said brassiere left cup and said brassiere right cup to a backside of said wearer.

12. The method of claim 11, further comprising connecting a left shoulder strap or a right shoulder strap between said brassiere front part and said brassiere back part.

13. The method of claim 10, wherein said brassiere underband comprises an inelastic material or an elastic material.

14. The method of claim 10, wherein said second underband length lesser than said first underband length.

15. The method of claim 14, wherein said first underband length allows a breast pump to be positioned between a brassiere wearer breast and a brassiere wearer side of said brassiere left cup and/or said a brassiere right cup.

16. The method of claim 15, wherein said second underband length mitigates movement of said breast pump positioned between said brassiere wearer breast and said brassiere wearer side of said brassiere left cup and/or said a brassiere right cup.

17. The method of claim 14, wherein said first connector part selectably interconnectable with any one of a plurality of second connector parts disposed in spaced apart relation along a portion of said brassiere underband to incrementally reconfigure said brassiere from a first brassiere configuration to each one of a plurality of states of a brassiere second configuration.

18. The method of claim 10, wherein said brassiere underband adjustor comprises one or more of: a slide, a slide having a hook, a J-hook and eye, a snap, hook and loop, a button and a button hole, and combinations thereof.

19. The brassiere of claim 6, wherein said second underband length increases efficiency of breast pumping with said breast pump positioned between said brassiere wearer breast and said brassiere wearer side of said brassiere left cup and/or said a brassiere right cup.

20. The brassiere of claim 15, wherein said second underband length increases efficiency of breast pumping with said breast pump positioned between said brassiere wearer breast and said brassiere wearer side of said brassiere left cup and/or said a brassiere right cup.

* * * * *